United States Patent [19]

Roberts et al.

[11] Patent Number: 4,650,598

[45] Date of Patent: Mar. 17, 1987

[54] METHOD AND EMULSIONS FOR THE CONTROL OF DUST

[75] Inventors: Brian G. Roberts, Bedford, Canada; Paul A. Rey, Coraopolis, Pa.

[73] Assignee: Calgon Corporation, Pittsburgh, Pa.

[21] Appl. No.: 713,148

[22] Filed: Mar. 18, 1985

[51] Int. Cl.[4] ..... C09K 11/02

[52] U.S. Cl. ..... 252/88; 252/173; 252/174.23; 252/DIG. 2; 299/12; 524/475; 524/560; 524/801

[58] Field of Search ..... 252/88, 174.23, 173, 252/DIG. 2; 299/12; 524/560, 475, 801

[56] References Cited

U.S. PATENT DOCUMENTS

| | | | |
|---|---|---|---|
| 3,690,727 | 9/1972 | Degginger | 299/12 |
| 3,691,124 | 9/1972 | Barron | 524/801 |
| 3,779,969 | 12/1973 | Slagel et al. | 524/560 X |
| 3,912,666 | 10/1975 | Spitzer et al. | 521/149 |
| 3,954,662 | 5/1976 | Salyer et al. | 252/382 |
| 4,000,992 | 1/1977 | Cole | 134/18 |
| 4,136,050 | 1/1979 | Brehm | 252/88 |
| 4,169,170 | 9/1979 | Doekson | 427/155 |
| 4,264,333 | 4/1981 | Shaw et al. | 44/6 |
| 4,290,925 | 9/1981 | Pennewiss et al. | 252/56 S |
| 4,316,811 | 2/1982 | Burns et al. | 252/88 |
| 4,400,220 | 8/1983 | Cole | 134/18 |
| 4,417,992 | 11/1983 | Bhattacharyya et al. | 252/88 |

FOREIGN PATENT DOCUMENTS

| | | |
|---|---|---|
| 8071776 | 3/1979 | Fed. Rep. of Germany . |
| 2524899 | 10/1983 | France . |
| 25871 | 2/1981 | Japan . |

*Primary Examiner*—Prince E. Willis

*Attorney, Agent, or Firm*—W. C. Mitchell; M. C. Sudol, Jr.

[57] ABSTRACT

The instant invention is directed to a method for suppressing dust comprising contacting a dust-producing material with an emulsion comprising: (a) 20–99.5%, by weight, water and (b) the balance a composition comprising at least one methacrylate polymer, at least one hydrophobic liquid, and at least one emulsifying surfactant. The instant invention is also directed to the above described emulsions.

20 Claims, No Drawings

METHOD AND EMULSIONS FOR THE CONTROL OF DUST

BACKGROUND OF THE INVENTION

This invention relates to dust suppression generally and more particularly to coal dust suppression. The use of methacrylate polymers and hydrophobic liquids such as kerosene and diesel fuel, emulsified in water, for the purpose of dust suppression is disclosed. The instant emulsions control dusting and windage loss at stock piles and during material handling and transport, and are also effective when applied to hauling roads around coal preparation plants, mills, mining sites and the like.

Dust suppression, as used herein, is defined as the prevention or reduction of the extent to which fine particulates become airborne or suspended in air. Dust is generated in significant quantities during the mining, handling, transportation, and storage of coal; dust is also generated during the processing, transportation and handling of rock, ores (for example iron ore), grains, taconite, sulfur, copper, limestone, gypsum, flyash, cement, bauxite and fertilizers (such as potash and phosphates), among others. Road dust is also a problem.

In coal mining applications, mechanical and chemical methods for dust control are known. For example, dust collection equipment is used in mining operations. Also, water is commonly used to prevent dust particles from becoming airborne. Additionally, aqueous solutions containing surfactants may be used for dust control (see U.S. Pat. No. 3,690,727 and 4,136,050). Aqueous foam compositions have also been used to suppress dust (see U.S. Pat. Nos. 3,954,662, 4,000,992 and 4,400,220). U.S. Pat. No. 4,316,811 discloses the use of an aqueous solution of polyethylene oxide for dust control. U.S. Pat. No. 4,169,170 discloses the use of an aqueous composition comprising an asphalt emulsion or a black liquor lignin product and a water soluble methoxylated alkylphenol or sulfosuccinate wetting agent to form a crust layer which provides protection against the loss of coal due to wind or the action of a coal transportation device.

The instant invention relates to the use of at least one methacrylate polymer, at least one emulsifying surfactant and at least one hydrophobic liquid for dust suppression, especially coat dust suppression. This admixture is then emulsified into water, preferably at the application site, to provide a dust suppressant having excellent penetration, binding and wetting properties which also provides efficient and inexpensive coverage of the material being treated. After application, the dust control agent provides a tacky, water-resistant coating which effectively prevents dusting while additionally acting as an antifreeze agent. The instant discovery provides excellent dust suppression relative to contemporary dust suppressants.

The emulsions and method of the instant invention constitute a notable advance in the art since they minimize the disadvantages of commonly used dust suppressants, such as compositions comprising water and surfactants. These disadvantages include, but are not limited to: (1) low persistence—with light usage, dust control may be only temporary due to evaporation; (2) adverse affect on BTU values—with heavy application, the effective BTU value of the coal being treated may be reduced; (3) expense—known coat dust suppressants are costly; (4) freezing—many coal dust suppressants currently in use do not aid in the prevention of freezing, and may, in fact, contribute to freezing; and (5) spontaneous combustion—conventional coat dust suppressants may contribute to spontaneous combustion due to the heat of wetting.

DESCRIPTION OF THE INVENTION

The instant invention is directed to a method of dust suppression, especially coal dust suppression, comprising contacting a dust-producing material with an effective amount of an emulsion comprising: (a) 20–99.5%, by weight, water and (b) the balance a composition comprising from about 0.1%, by weight, to about 20%, by weight, of at least one methacrylate polymer, on an active basis, a minimum of about 70%, by weight, of at least one hydrophobic liquid and about 0.01–10%, by weight, of at least one emulsifying surfactant. The term 'effective amount' means that amount of emulsion necessary to inhibit or eliminate dusting of the material being treated; at a minimum, at least 0.1 Kg of emulsion/metric ton of the material being treated must be added for complete control. For surface treatment, at least 0.1 Kg of emulsion/$m^2$ surface area of the material being treated must be added.

The instant emulsions are prepared by first combining at least one methacrylate polymer with at least one hydrophobic liquid. This admixture is then emulsified into water by use of at least one emulsifying surfactant, which is preferably added to the methacrylate polymer/hydrophobic liquid composition. An effective amount of emulsifying surfactant must be used, with the term "effective amount" referring to that concentration of surfactant or surfactants necessary to provide a consistent, stable emulsion. The preferred emulsifying surfactant dosage ranges from 0.1–6%, by weight, of the polymer/hydrophobic liquid/surfactant composition.

The instant invention is additionally directed to an emulsion useful as a dust suppressant comprising: (a) 20–99.5%, by weight, water and (b) the balance a composition comprising from about 0.1%, by weight, to about 20%, by weight, of at least one methacrylate polymer, on an active basis, a minimum of 70%, by weight, of at least one hydrophobic liquid and about 0.01–10%, by weight, of at least one emulsifying surfactant. In these emulsions, the preferred emulsifying surfactant dosage ranges from 0.1 to 6%, by weight, of the polymer/hydrophobic liquid/surfactant compositions.

Any methacrylate polymer can be used. As used herein, "methacrylate polymers" are those polymers prepared from: (1) monomers having the generic formula $CH_2=C(CH_3)COOR$, wherein R is selected from the group consisting of any straight or branched alkyl group having less than or equal to 12 carbon atoms and preferably having 4–12 carbon atoms, alone or in combination, and (2) one or more of the above-described monomers in combination with any monomer having the generic formula $CH_2=CH\text{-}COOR^1$, wherein $R^1$ is any straight or branched alkyl group having less than 6 carbon atoms, alone or in combination. Additionally, R and $R^1$ include substituted straight or branched alkyl groups such as 2-ethyl hexyl and 2-ethyl butyl, wherein at least one of the H's of the above straight or branched chain alkyl groups is replaced by an alkyl group having three carbons or less.

Preferred methacrylates are homopolymers of methacrylate, methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, 2-ethyl butyl methacrylate, and 2-ethyl hexyl methacrylate, including all isomers thereof.

The most preferred methacrylates are homopolymers of 2-ethyl hexyl methacrylate and isodecyl methacrylate.

Molecular weight of the methacrylate is not critical. However, it is preferred that the methacrylate have a molecular weight in excess of 2,000, as determined by light scattering techniques.

The term hydrophobic liquid, as used herein, is defined as a fluid which is not miscible with water. Any hydrophobic liquid can be used. The preferred hydrophobic liquids are those selected from the group consisting of mineral oils, fuel oils, diesel fuels or oils, kerosene, naphthas, petroleums, and blends of aromatic and aliphatic hydrocarbons containing four or greater carbon atoms, alone or in combination. The most preferred hydrophobic liquids are those selected from the group consisting of fuel oils, diesel fuels or oils, kerosene, and mixtures of these hydrophobic liquids.

Preferred compositions comprising at least one methacrylate polymer, at least one hydrophobic liquid and at least one emulsifying surfactant preferably contain 0.1 to 10%, by weight, of at least one methacrylate polymer, on an active basis, 0.1 to 6%, by weight, of at least one emulsifying surfactant and at least 84%, by weight, of at least one hydrophobic liquid. These compositions preferably comprise 30–70%, by weight, of the instant emulsions, with the balance being water.

Blends of methacrylates can be used, as can blends of various hydrophobic liquids. For example, a composition comprising a methacrylate polymer and kerosene may be prepared. The kerosene improves the viscosity properties of the methacrylate polymer. This composition may be further diluted with a second hydrophobic liquid, including but not limited to a diesel fuel to number 5 fuel oil. The second hydrophobic liquid is preferably heavier and more viscous than the kerosene, thereby promoting better binding of the fine dust particles. The kerosene:heavy second oil ratio in the above composition can range from 1:20 to 20:1, on a weight:weight basis, with the preferred weight ratio being 1:10 to 10:1. The most preferred weight ratio is 1:1 to 1:6. The total weight of the hydrophobic phase, however, remains at greater than or equal to 70%, by weight, of the polymer/hydrophobic liquid/surfactant composition.

The dust suppressants of the instant invention are oil-in-water emulsions. Thus, the instant methacrylate/-hydrophobic liquid/surfactant compositions must be emulsified into water. Any surfactant which functions as an emulsifier can be used. By emulsion, it is meant that the oil-polymer phase is present in the water, or external, phase in the form of droplets. Thus, the instant emulsions have water as the continuous phase and the hydrophobic liquid as the dispersed phase.

The final emulsion product preferably comprises 30%–70%, by weight, water and 70%-30%, by weight, hydrophobic liquid/polymer/emulsifying surfactant compositions. The most preferred emulsions comprise about 45–55%, by weight, water and about 55-45%, by weight, hydrophobic liquid/polymer/emulsifying surfactant composition. However, emulsions comprising up to 99.5% water can be used in certain applications, such as when coal having a moisture content greater than 10% is being treated.

Nonionic or anionic emulsifying surfactants can be used, alone or in combination. Nonionic emulsifying surfactants must have high HLB (hydrophile-lipophile balance) numbers, i.e. HLB values greater than or equal to 8.0. High HLB values indicate that these surfactants are strongly hydrophilic, and that they are good oil-in-water emulsifiers. Additionally, the preferred emulsifying surfactants should have good wetting, binding and penetration characteristics.

The preferred emulsifying surfactants are selected from the group consisting of: (1) nonionic surfactants having an HLB value greater than 8.0, such as polyoxyethylene ethoxylates, polyethylene glycol ethers, alcohol ethoxylates, and alkyl phenol ethoxylates; and (2) anionic surfactants such as phosphate ester-containing surfactants, sulfosuccinates, alkyl sulfates, ethoxylated alkyl phenol sulfates, alkyl ether sulfates, fatty ester sulfates, sulfated alcohol ethoxylates, and salts thereof. The most preferred emulsifying surfactants are selected from the group consisting of polyethylene glycol ethers of linear alcohols, alkyl phenol ethoxylates, phosphate ester-containing surfactants, alkyl ether sulfates and sulfosuccinates, and salts thereof, including but not limited to sodium and potassium salts. Preferred examples of polyethylene glycol ethers of linear alcohols include, but are not limited to, Tergitol 15S-5, Tergitol 15S-7 and Tergitol 15S-9, all available from Union Carbide Corporation, having 5, 7 and 9 moles EO and approximate HLB values of 10.5, 12.1 and 13.3, respectively.

A preferred alkyl phenol ethoxylate is an ethoxylated octyl phenol (degree of ethoxylation, $n=10$) having and HLB value of approximately 13.5. A preferred example of a phosphate ester-containing surfactant is Gafac RS-610, which is described as a phosphate ester free acid with an aliphatic hydrophobic base, which is available from GAF Corporation. Preferred alkyl ether sulfates are sodium salts of alkyl ether sulfates.

Preferred examples of sulfosuccinates include but are not limited to sodium dioctyl sulfosuccinate, such as Aerosol OT-75, disodium ethoxylated alcohol half ester of sulfosuccinide acid, such as Aerosol A-102, and disodium ethoxylated nonylphenol half ester of sulfosuccinic acid, such as Aerosol A-103, all available from American Cyanamid Company.

An effective amount of the emulsifying surfactant must be used. The term effective amount denotes that amount of surfactant necessary to completely emulsify the hydrophobic liquid/polymer composition into water, thereby forming a consistent, stable emulsion. The preferred surfactant dosage is 0.1–6%, by weight, of the polymer/hydrophobic liquid/surfactant composition.

Combinations of emulsifying agents may also be used to formulate the instant dust suppressants.

The final emulsification step can be conducted at the dust treatment site. This method saves the cost of transporting water. Thus, a composition comprising at least one methacrylate polymer, at least one hydrophobic liquid and at least one emulsifying surfactant is prepared and transported to the treatment site. Immediately prior to application, the composition is emulsified into water. The water is used as an inexpensive means to transport and distribute the dust suppressant. Water may form 20–99.5%, by weight, of the final emulsion. The amount of water may be optimized, however, so as not to substantially lower the BTU value of the dust suppressant or cause freezing in cold temperatures.

The emulsion can be formulated using any of several technologies known in the art, including but not limited to injection of the methacrylate polymer/hydrophobic liquid/emulsifying surfactant composition into a water lime which may or may not contain an in-line mixing device or use of an agitated vessel.

The dust suppressant emulsions of the instant invention are suitable for use on any material prone to create dust, including but not limited to rock, ores (such as iron ore), taconite, sulfur, copper, limestone, gypsum, flyash, cement, bauxite, ash, sinter, coke, mineral concentrates and fertilizers, including but not limited to potash and phosphate fertilizers. These emulsions are also excellent agents for the control of road dust. If the material being treated is water soluble, the water content of the emulsion should be minimized. In such cases, 20–30% water, by weight, is preferred.

The dust suppressant emulsions of the instant invention are especially effective when applied to coal by way of the commonly known techniques employed in the art, including but not limited to spraying or otherwise contacting the coal with the dust suppressant emulsions. Spraying is preferred. The instant method of coal dust suppression involves contacting the coal being treated with the dust suppressant. Preferably, all of coal being treated, not only the surface of the coal, such as the surface area of a coal pile on the coal in a rail car, is contacted with the emulsion. Thus, a preferred method of treating coal is to spray the coal with the emulsion of the instant invention while loading it into a transportation device, such as a rail car, truck or conveying system. However, surface spraying can also be used. Use of the instant dust suppressants minimizes or eliminates dusting of the coal during transport and subsequent handling while additionally protecting against freezing and possibly enhancing the BTU value of the coal. Dust suppression is excellent due to the persistence of the emulsions, due to their exceptional penetrating qualities and due to their ability to agglomerate and bind fine coal particles, i.e. those less than 10 microns in diameter, to more coarse coal. Also, emulsions of up to 50%, by weight, water may enhance the BTU value of the coal, while providing freeze protection.

The instant emulsions can be added at any effective dosage. Required dosages are at least 0.1 Kg per metric ton of total solids being treated if all of the material being treated is contacted (i.e., total solids basis), and at least 0.1 $Kg/m^2$ of surface area if surface treatment is being used. Preferred dosages are 0.1–80 Kg per metric ton and 0.1–50 $Kg/m^2$ for total contact and surface treatment, respectively. Most preferred dosages are 2–20 Kg/metric ton and 2–15 $Kg/m^2$, for total contact and surface treatment, respectively.

Additionally, compositions comprising from about 0.1%, by weight, to about 20%, by weight, of at least one methacrylate polymer, on an active basis, a minimum of about 70%, by weight, of at least one hydrophobic liquid and about 0.01–10%, by weight, of at least one emulsifying surfactant can be used without water in applications where water cannot be tolerated or is undesirable.

EXAMPLES 1–6

Coal dust suppressant emulsions were prepared by mixing 250 grams diesel fuel with a 50 gram composition comprising 6%, by weight, 2-ethyl hexyl methacrylate polymer and 94%, by weight, kerosene. Three grams (active basis) of an emulsifying agent were then added. (Various emulsifiers were used, as shown below). Acceptable emulsifying agents produced stable dispersions of the composition into water, on a 1:1 weight basis (i.e. 303 grams of water). The following surfactants were utilized:

Aerosol OT-75, which is a 75% active sodium dioctyl sulfosuccinate, available from American Cyanamid Company;

Tergitol 15S-3, 15S-5, 15S-7 and 15S-9, which are polyethylene glycol ethers of linear alcohols having 3, 5, 7 and 9 moles of EO, respectively, available from Union Carbide Corporation.

These experiments are not intended to in any way limit the scope of this invention.

TABLE 1

| Ex. | Surfactant Used | Foam | Emulsion Stability |
|---|---|---|---|
| 1* | None | No | Separation within 5 minutes |
| 2 | Aerosol OT 75 | Yes | No separation within 1 hour |
| 3 | Tergitol 15S-3 | No | Separation within 5 minutes |
| 4 | Tergitol 15S-5 | Yes | Slight separation within 1 hour |
| 5 | Tergitol 15S-7 | Yes | Slight separation within 1 hour |
| 6 | Tergitol 15S-9 | Yes | Slight separation within 1 hour |

*Comparison example

EXAMPLES 7–15

Transportation tests were run on sub-bituminous coals being shipped via rail. The coal of examples 7–14 had an inherent mosture level of approximately 8% and an energy value of approximately 6,000 Kcal/metric ton. The coal of example 15 had an inherent moisture level of approximately 10.5% and an energy value of approximately 5700–5800 Kcal/metric ton. The journey in each case was approximately 800 miles. Dust suppression efficacy was recorded at the unloading site. Results are shown in Table 2, below. In Examples 7–15, the following dust suppressants were evaluated: water, DCF-20 foam (commercially available from Calgon Corporation, Pittsburgh, Penn.), ammonium ligno sulphonate (commercially available from Alchem, Inc., as Alchem 3WF943), calcium ligno sulphonate (commercially available from Benetech, Inc.), DCL-1870 anionic surfactant (commercially available from Calgon Corporation), Alchem 8 A08 polymer binder (commercially available from Alchem, Inc.), the emulsion of example 2 and a 1:99 hydrophobic liquid-surfactant-polymer:water emulsion (weight:weight basis) which contained 1%, by weight, of the kerosene/diesel fuel/Aerosol OT-75/2-ethyl hexyl methacrylate admixture of Example 2 and 99%, by weight, water.

These examples are not intended to in any way limit the scope of this invention.

TABLE 2

| Example | Dust Suppressant | Dusting at Unloading Site |
|---|---|---|
| 7 | None | Excessive |
| 8 | Water, applied at unloading site with spray bars and fire hoses | Excessive |
| 9 | DCF-20 foam, applied at recommended dosage of 1% (coal weight basis) at coal loading facility | Excessive |
| 10 | Ammonium ligno sulphonate solution, applied at coal loading facility at recommended dosage | Excessive |
| 11 | Calcium ligno sulphonate solution, applied at coal loading facility at recommended dosage | Excessive |
| 12 | DCL-1870 anionic surfactant, applied at recommended dosage of 1% (coal weight basis) | Excessive |

TABLE 2-continued

| Example | Dust Suppressant | Dusting at Unloading Site |
|---|---|---|
| | at coal loading facility | |
| 13 | Alchem 8 A08 polymer binder, applied at coal loading facility at recommended dosage | Excessive |
| 14 | 50:50 methacrylate-diesel-kerosene-Aerosol OT-75:water emulsion, added at dosage of 1% (coal weight basis) at coal loading facility (Aerosol OT-75 is sodium dioctyl sulfosuccinate) | Excellent control, dusting minimal w/o use of supplemental water sprays |
| 15 | 1:99 methacrylate-deisel-kerosene-Aerosol OT-75:water emulsion, added at dosage of 1% (coal weight basis) at coal loading facility | Good control, showed sufficient persistence on coal having a moisture content above 10.0% |

What is claimed is:

1. A method of suppressing dust, comprising contacting a dust-producing material with an effective amount of an emulsion comprising: (a) 20–99.5%, by weight, water and (b) the balance a composition comprising from about 0.1% to about 20%, by weight of the composition of (b), of at least one methacrylate polymer, on an active basis, a minimum of about 70%, by weight of the composition of (b), of at least one hydrophobic liquid and about 0.01% to about 10%, by weight of the composition of (b), of at least one emulsifying surfactant.

2. The method of claim 1, wherein said dust-producing material is selected from the group consisting of coal, rock, ores, taconite, sulfur, copper, limestone, gypsum, flyash, cement, bauxite, ash, sinter, coke, mineral concentrates, fertilizers and road dust.

3. The method of claim 2, wherein said dust-producing material is coal.

4. The method of claim 1, wherein said methacrylate polymer is selected from the group consisting of polymers prepared from: (1) monomers having the generic formula $CH_2=C(CH_3)COOR$, wherein R is selected from the group consisting of any straight or branched chain alkyl group having less than or equal to 12 carbon atoms, alone or in combination; (2) one or more of the monomers of group (1) in combination with any monomer having the generic formula $CH_2=CH\text{-}COOR^1$, wherein $R^1$ is any straight or branched alkyl group having less than 6 carbon atoms, alone or in combination; and (3) monomers of group (1) or group (2), wherein R and $R^1$ are substituted straight or branched alkyl groups having less than or equal to 12 carbon atoms and less than 6 carbon atoms, respectively, wherein at least one of the H's of R or $R^1$ is replaced by an alkyl group having three carbons or less, alone or in combination.

5. The method of claim 4, wherein said methacrylate polymer is selected from the group consisting of homopolymers of: methacrylate, methyl methacrylate, ethyl methacrylate, propyl methacrylate, butyl methacrylate, pentyl methacrylate, heptyl methacrylate, octyl methacrylate, nonyl methacrylate, decyl methacrylate, 2-ethyl-butyl methacrylate and 2-ethyl hexyl methacrylate.

6. The method of claim 5, wherein said methacrylate polymer is selected from the group consisting of homopolymers of 2-ethylhexyl methacrylate and homopolymers of isodecyl methacrylate.

7. The method of claim 1 wherein said hydrophobic liquid is selected from the group consisting of mineral oils, diesel fuels or oils, kerosene, naphthas, petroleums and blends of aromatic and aliphatic hydrocarbons containing four or greater carbon atoms.

8. The method of claim 1, wherein said emulsifying surfactant is selected from the group consisting of nonionic surfactants having an HLB value greater than 8.0 and anionic surfactants selected from the group consisting of sulfosuccinates, phosphate ester-containing surfactants, alkyl sulfates, ethoxylated alkyl phenol sulfates, alkyl ether sulfates, and sulfated alcohol ethoxylates, and salts thereof.

9. The method of claim 8, wherein said emulsifying surfactant is selected from the group consisting of polyethylene glycol ethers of linear alcohols having at least 5 moles EO, ethoxylated octyl phenol, sodium dioctyl sulfosuccinate, disodium ethoxylated alcohol half esters of sulfosuccinic acid, disodium ethoxylated nonyl phenol half esters of sulfosuccinic acid, a phosphate ester free-acid with an aliphatic hydrophobic base and sodium salts of alkyl ether sulfates.

10. The method of claim 1, wherein said emulsion comprises: (a) 30–70%, by weight water and (b) the balance a composition comprising 0.1–10%, by weight of the composition of (b), of at least one methacrylate polymer, on an active basis, 0.1–6%, by weight of the composition of (b), of at least one emulsifying surfactant and at least 84%, by weight of the composition of (b), of at least one hydrophobic liquid.

11. The method of claim 10 wherein said emulsion comprises 45–55% water.

12. The method of claim 1 wherein said hydrophobic liquid comprises kerosene and a second, heavier component selected from the group consisting of diesel fuel or oil and fuel oils.

13. A method of suppressing coal dust, comprising contacting coal with an emulsion comprising: (a) 20–99%, by weight, water and (b) the balance a composition comprising 0.1 to 20%, by weight of the composition of (b), of at least one methacrylate polymer selected from the group consisting of homopolymers of 2-ethyl hexyl methacrylate and homopolymers of isodecyl methacrylate, at least 70%, by weight of the composition of (b), a hydrophobic liquid selected from the group consisting of kerosene, diesel fuel or oil, fuel oils, and combinations thereof, and 0.01 to 10%, by weight of the composition of (b), of an emulsifying surfactant selected from the group consisting of nonionic surfactants having HLB values greater than 8.0, sulfosuccinates, phosphate ester-containing surfactants, alkyl sulfates, ethoxylated alkyl phenol sulfates, alkyl ether sulfates and sulfated alcohol ethoxylates, and salts thereof, wherein said emulsion is added at a dosage of at least 0.1 Kg/metric ton on a total solids basis or at a dosage of at least 0.1 $Kg/m^2$ on a surface area basis.

14. The method of claim 13 wherein said emulsion comprises 30–70%, by weight, water.

15. An emulsion useful as a dust suppressant consisting essentially of:

(a) 20–99.5%, by weight, water and (b) the balance a composition consisting essentially of from about 0.1%, by weight of the composition of (b), to about 20%, by weight of the composition of (b), of at least one methacrylate polymer, a minimum of about 70%, by weight of the composition of (b), of at least one hydrophobic liquid and about 0.01% to about 10%, by weight of the composition of (b) of at least one emulsifying surfactant.

16. The emulsion of claim 15, wherein said methacrylate polymer is selected from the group consisting of homopolymers of 2-ethyl hexyl methacrylate and isodecyl methacrylate, wherein said hydrophobic liquid is selected from the group consisting of kerosene, diesel oils or fuels, fuels oils, and combinations thereof, and wherein said emulsifying surfactant is selected from the group consisting of polyethylene glycol ethers of linear alcohols having at least 5 moles EO, ethoxylated octyl phenol, sodium dioctyl sulfosuccinate, disodium ethoxylated alcohol half esters of sulfosuccinic acid, disodium ethoxylated nonyl phenol half esters of succinic acid, a phosphate ester free-acid with an aliphatic hydrophobic base and sodium salts of alkyl ether sulfates.

17. The emulsion of claim 15 comprising: (a) 30–70%, by weight, water and (b) the balance a composition comprising from 0.1–10%, by weight of the composition of (b), of at least one methacrylate polymers, on an active basis, 0.1–6%, by weight of the composition of (b), of at least one emulsiying surfactant and at least 84%, by weight of the composition of (b), of at least one hydrophobic liquid.

18. The emulsion of claim 17 comprising 45–55%, by weight, water.

19. The emulsion of claim 16, wherein said hydrophobic liquid comprises kerosene and a second, heavier component selected from the group consisting of diesel fuel or oil and fuel oils.

20. The emulsion of claim 15, wherein said emulsion is an emulsion for coal dust suppression.

* * * * *